United States Patent [19]

Newell et al.

[11] 4,119,888

[45] Oct. 10, 1978

[54] OPERATING CIRCUIT FOR FLASH LAMP DIRECTLY COUPLED TO AC SOURCE

[75] Inventors: P. Bruce Newell, Carlise; James C. Morris, Wakefield, both of Mass.

[73] Assignee: GTE Sylvania Incorporated, Stamford, Conn.

[21] Appl. No.: 777,872

[22] Filed: Mar. 15, 1977

[51] Int. Cl.[2] ..... H05B 41/32

[52] U.S. Cl. ..... 315/205; 315/207

[58] Field of Search ..... 315/200 R, 205, 207, 315/227 R, 246, 272, 171

[56] References Cited

U.S. PATENT DOCUMENTS

| | | | |
|---|---|---|---|
| 2,575,001 | 11/1951 | Bird | 315/207 X |
| 3,544,840 | 12/1970 | Saiger | 315/205 |

*Primary Examiner*—Eugene R. LaRoche

*Attorney, Agent, or Firm*—Edward J. Coleman

[57] ABSTRACT

A circuit for operating an arc discharge flash lamp that is directly coupled across an alternating current (AC) source. The lamp is ignited by a high voltage pulse generated by a trigger circuit energized by the AC source. A voltage multiplier, such as a doubler circuit, is connected across the flash lamp for increasing the voltage across the lamp above that provided by the AC source, thereby facilitating starting of the lamp by the trigger circuit.

8 Claims, 4 Drawing Figures

OPERATING CIRCUIT FOR FLASH LAMP DIRECTLY COUPLED TO AC SOURCE

BACKGROUND OF THE INVENTION

This invention relates generally to electrical circuits for operating arc discharge flash lamps and, more particularly, to an improved operating circuit for a flash lamp directly coupled to an alternating current (AC) source.

Flashlamps of the type referred to herein generally comprise two electrodes spaced apart within an hermetically sealed glass envelope having a rare gas fill, typically xenon at a subatmospheric pressure. In typical prior art operating circuits, such lamps are connected across a large energy storage device, such as a bank of capacitors, charged to a substantial potential, but insufficient to ionize the xenon gas fill. Upon application of an additional pulse of sufficient voltage, the xenon is ionized and an electric arc is formed between the two electrodes, discharging the storage device through the flashlamp, which emits a burst of intense light. In many cases the pulse voltage is applied between an external trigger electrode, such as a wire wrapped around the envelope, and one of the internal electrodes; this is referred to as shunt triggering; however, in other cases an external wire is not feasible since it may result in undesirable arcing between the trigger wire and a proximate lamp reflector, or else the high potential applied to the external trigger wire might be hazardous to operating personnel. In those cases, the lamp may be internally triggered by applying the pulse voltage directly across the lamp electrodes, a technique referred to as injection, or series, triggering. Usually the voltage required is about 30 to 50 percent higher than that required to trigger the same lamp with an external trigger wire, and the trigger transformer secondary must carry the full lamp current.

Such flashlamps are employed in a variety of applications; for example, flash photography; reprographic machines; laser excitation; and warning flashers for airplanes, towers, road barriers, marine equipment and tower mounted approach lighting systems for airport runways. Typical prior art power supplies pose serious disadvantages for a number of these applications, however, as the required energy storage devices, such as large banks of capacitors, tend to be bulky, heavy and expensive, as are the required step-up power transformers. This is particularly apparent in endeavors to provide compact, low cost photographic flashlamps, or light weight runway flashers for mounting on frangible towers. Accordingly, it is particularly desirable to find a means for eliminating the large energy storage devices in flash lamp power supplies. In pursuit of this end, it has been observed that much higher than average short duration currents are routinely drawn from AC power lines; for example, compressor motor starting transients (locked rotor currents) are four to seven times their running currents. Metal fuses, another example, can handle peak half cycle currents of ten or more times their continuous ratings. Hence, in order to overcome the aforementioned disadvantages, it has been proposed to take advantage of this high transient current reserve capacity of conventional 120 volt, 60 Hertz AC power sources, or other commonly available lines, to draw controlled pulses of high current to operate flash lamps. Three U.S. patents that describe the direct coupling of flash lamps to an AC source are U.S. Pat. No. 3,497,768 Mathisen, U.S. Pat. No. 3,745,896 Sperti et al (FIGS. 20–25 and col. 14 on) and U.S. Pat. No. 3,896,396 Whitehouse et al. These patents are described in some detail in the background section of a copending application Ser. No. 775,122, filed Mar. 7, 1977, assigned to the same assignee as the present application.

Many xenon flash lamps, however, do not trigger well at the relatively low voltages that are encountered directly from AC service. Moreover, xenon lamps, in order to operate efficiently, must be filled to relatively high pressures (perhaps even exceeding atmospheric), a situation which further increases the triggering requirements. To assure starting lamps of relatively high fill pressure or of long arc lengths, therefore, higher voltages than are available from the line may be required. This may be true even though the lamp will operate well from the AC source at low voltages once completely ionized by triggering. The aforementioned Whitehouse et al patent counters this problem by employing a pair of capacitors across the lamp in connection with a capacitor charger to add to the current surge through the lamp during initial firing. The circuit is shown in FIG. 3 of the patent. The charger is described as including a transformer energized by a third phase of the AC source and a rectifying diode. Although providing the desired starting aid, it is apparent that the Whitehouse et al solution reintroduces into the circuitry comparatively bulky, heavy and expensive components, thereby significantly diminishing the advantages obtained by direct line coupling.

SUMMARY OF THE INVENTION

Accordingly, it is an object of the present invention to provide an improved power supply for operating arc discharge flash lamps.

It is a particular object to provide an improved circuit for operating a flashlamp directly coupled to an AC source.

Another object is to provide a relatively compact and inexpensive circuit means for facilitating starting of the lamp when triggered.

These and other objects, advantages and features are attained, in accordance with the principles of the present invention, by providing a voltage multiplier across the flashlamp for increasing the voltage across the lamp above that provided by the AC source. In a preferred embodiment of a circuit for operating an arc discharge flashlamp directly coupled across a source of operating current and having a trigger pulse generating means coupled thereto, the starting aid comprises a modified form of a voltage doubler coupled across the lamp. More specifically, a parallel-connected diode and capacitor combination is connected in series with the lamp, and a second diode is arranged in parallel with the lamp, the cathodes of the two diodes being connected together. In this manner, the voltage across the lamp is approximately doubled for a single phase system and quadrupled for a split phase system by using a minimum of components suited to compact light weight packaging techniques. The modified doubler also provides the additional function of assuring lamp turn off when the AC source goes to the opposite polarity from that at which ignition occurred. More specifically, say the lamp is to be ignited during positive half cycles of the AC source; once the lamp is started, the diode-capacitor circuit ceases to function as a voltage doubler and the series diode directly couples the lamp to the AC source and assures turn off of the lamp during negative half-cycles.

The diode-capacitor circuit may be further modified by placing a resistor across the capacitor to bleed off any residual charge when the circuit is deenergized. This provides an additional safety feature by assuring all stored charges are dissipated when the circuit is disconnected for servicing. A resistor may also be connected in series with the diode coupled across the lamp so as to limit the current therethrough and, thus, permit use of a less expensive diode of reduced current rating. The resistors may also function as a voltage divider for "tuning" the voltage provided by the multiplier across the lamp.

BRIEF DESCRIPTION OF THE DRAWING

This invention will be more fully described hereinafter in conjunction with the accompanying drawings, in which.

DESCRIPTION OF PREFERRED EMBODIMENT

Figure 1:
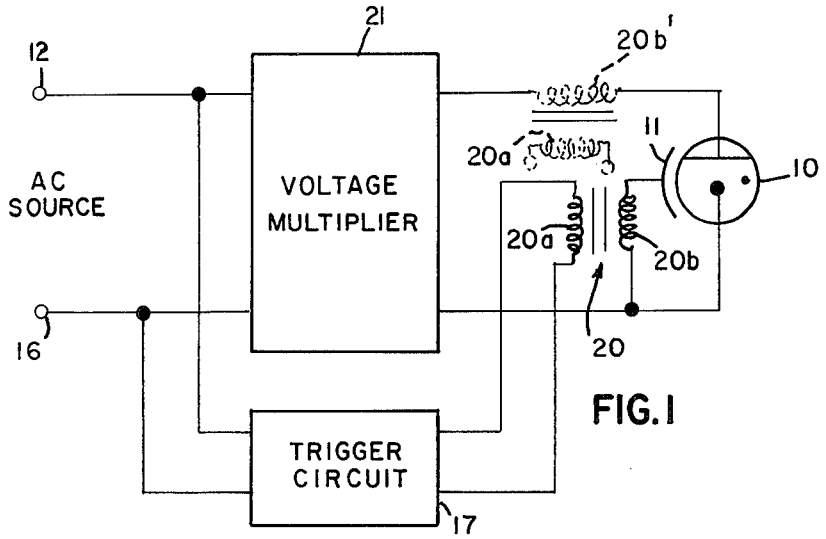
FIG. 1 is a simplified circuit diagram showing a flashlamp operated from an AC source in accordance with the present invention.

Referring to FIG. 1, the anode and cathode electrodes of the arc discharge lamp 10, which is preferably an xenon flashlamp, are coupled across terminals 12 and 16 of an AC source, which may comprise a conventional 120 volt, 60 Hertz power line. A trigger circuit 17 has a pair of input lines connected across the AC source 12, 16 and a pair of output lines connected across the primary winding **20*a* of a pulse transformer 20. The secondary winding 20*b* of the pulse transformer is connected between the cathode of lamp 10 and an external trigger electrode 11 mounted in close proximity to the flashlamp 10 for capacitively coupling pulsed high voltage to the lamp. Hence, the lamp is adapted to be shunt triggered. Alternatively, if it is desired to employ injection triggering of the lamp, the secondary winding of pulse transformer 20 would be connected in series with the flashlamp 10, as illustrated in the drawing by the dashed line representation labeled 20*b***.

Figure 2:
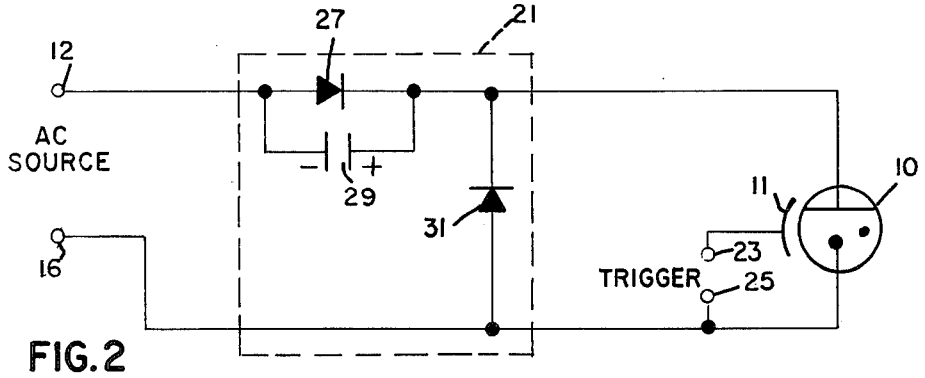
FIG. 2 is a flashlamp operating circuit including one embodiment of a multiplier in accordance with the invention.

In accordance with the present invention, FIG. 1 also illustrates a voltage multiplier 21 coupled across flashlamp 10 for increasing the voltage across the lamp above that provided by the alternating current source 12, 16, thereby facilitating starting of the lamp by the high voltage pulses generated from trigger circuit 17. In accordance with the principles of the invention, multiplier 21 should be an inexpensive, low joule, low current circuit. FIG. 2 illustrates one specific embodiment of a multiplier which uniquely meets these requirements. Similar components in FIG. 2 are labeled in like manner to the corresponding components of FIG. 1, with the trigger pulse source being represented by terminals 23 and 25 for purposes of simplifying the drawing. That is, secondary winding **20*b* would be connected across terminals 23 and 25. In this instance, the multiplier comprises a first diode 27 connected in series with the lamp between the anode thereof and AC terminal 12, a capacitor 29 connected across diode 27, and a second diode 31 connected in parallel with lamp 10. The multiplier of FIG. 2 resembles an ordinary voltage doubler but differs therefrom in that the circuit does not filter the rectified alternating current and functions in a different manner upon ignition of the lamp, as shall be described hereinafter. Assuming a single phase source with the voltage at terminal 12 being represented by $V_o \sin\omega t$, capacitor 29 is charged through diode 31 in the polarity shown in FIG. 2 to a voltage equal to the maximum value of the peak voltage $V_o$. When $V_o \sin\omega t$ swings positive, the voltage across the lamp, $V_1$, is raised to $2V_o$. The voltage $V_1$ will then continue to oscillate from 0 to $2V_o$ with every cycle of the AC source. The lamp may be triggered any time during the period that the voltage $V_1$ is sufficient to ensure breakdown. With the circuit connections illustrated, the flashlamp 10 is adapted to be ignited and, once ignited, will emit light and conduct only during the positive half cycles of the single phase AC power source 12, 16. The multiplier functions as a voltage doubler up to the point of lamp ignition. Contrary to a regular doubler, however, the circuit also provides the additional function of assuring that the lamp turns off when the voltage waveform of the AC source goes negative. More specifically, when the lamp fires, capacitor 29 discharges and diode 27 conducts thereby effectively removing the voltage doubler from the circuit. Hence, once the lamp is started, the multiplier ceases to function as a voltage doubler, and the series diode 27** directly couples the lamp to the AC source and assures turn off of the lamp during negative half cycles.

The circuit of FIG. 2 is also suitable for operation with the AC terminals connected to split phase power lines. In this instance the voltage at AC terminal 12 is expressed as $V_o \sin\omega t$, while the voltage at AC terminal 16 is $-V_o \sin\omega t$. When $V_o$ at terminal 12 is negative, $V_o$ at terminal 16 is positive; hence, capacitor 29 of the split phase circuit is charged in the polarity shown to a voltage equal to $2V_o$, through diode 31. When $V_o \sin\omega t$ swings positive at terminal 12 the voltage at the anode of lamp 10 will then reach a value of $3V_o$ when the voltage at the cathode is $-V_o$. The total voltage across the lamp, $V_1$, is then $4V_o$.

In the single phase circuit of FIG. 2, diode 27 must have a peak inverse voltage (PIV) rating of $V_o$. In the split phase version of FIG. 2, diode 27 must have a PIV of $2V_o$. In both instances, the diode must have a forward surge rating capable of withstanding the lamp current. In the single phase circuit of FIG. 2, diode 31 must have a PIV equal to $2V_o$, whereas in the split phase variation of FIG. 2, diode 31 must have a PIV rating of $4V_o$. In both instances, the forward current through diode 31 is determined by the reactive impedance of capacitor 29.

Figure 3:
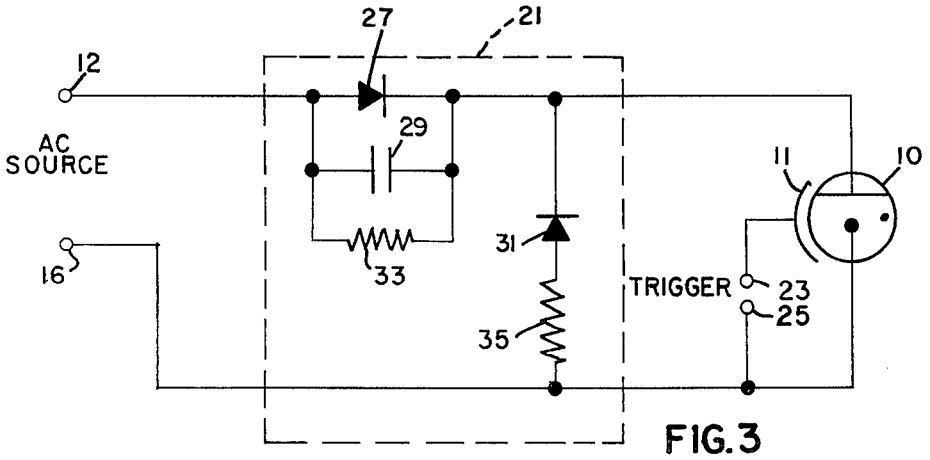
FIG. 3 is a flashlamp operating circuit including another embodiment of a multiplier according to the invention.

The multiplier circuit of FIG. 2 may be modified as shown in FIG. 3 to provide additional flexibility and advantages by connecting a first resistor 33 across capacitor 29 and/or by connecting a second resistor 35 in series with diode 31. Resistor 33 serves to bleed off any residual charge on capacitor 29 when the circuit is deenergized. This provides an additional safety feature by assuring that all stored charges in the lamp power supply are dissipated when the circuit is disconnected for servicing. The resistor 35 functions to limit the current through diode 31 and thereby permits a reduction in the size and cost of the required diode. Resistors 33 and 35 also function individually or together as a voltage divider for "tuning" the voltage $V_1$ provided by the multiplier circuit across the lamp 10. More specifically, the lamp voltage is affected by the dividing ratio of resistors 33 and 35 according to the following equation, $$V_{1\,max} = V_{o}[1 + R_{33}/(R_{33} + R_{35})]$$

Hence, by a judicious choice of resistors 33 and 35, the voltage $V_1$ may be "tuned" so as not to apply an overvoltage to the lamp. The time constant of the multiplier resistance and capacitance may require several cycles to charge up the capacitor 29.

By way of example, a specific embodiment of a flashlamp operating circuit according to the invention will now be described with reference to FIG. 4. Lamp 10 is connected across AC terminals 12 and 16 as previously described. The AC source may be a conventional single phase 120 volt, 60 Hertz power line. The trigger circuit is of the type described in copending application Ser. No. 775,122, assigned to the assignee of the present application. Hence, the high voltage pulse generator comprises a pulse transformer 20, a voltage doubler 22 and a controlled switching means 24, such as a silicon controlled rectifier (SCR). The voltage doubler consists of resistor 26, capacitors 28 and 30, and of diodes 32 and 34. Components 26, 28, 32 and 30 are series connected in that order with the primary winding 20*a* of the pulse transformer across the AC source 12, 16. Diode 34 is connected, as shown, between AC terminal 16 and junction of components 28 and 32.

The secondary winding 20*b* of the pulse transformer is connected between the cathode of lamp 10 and the external trigger electrode 11. Capacitor 28 of the voltage doubler typically is from about one-tenth to one-fifteenth the value of capacitor 30. For example, in one specific embodiment operating from a 120 volt, 60 Hertz source, capacitor 30 is 0.15 microfarad, and capacitor 28 is 0.01 microfarad. Accordingly, capacitor 30 will charge to about 300 volts DC after approximately five completed cycles of a 60 Hertz, 120 volt input; that is about 80 milliseconds. SCR 24 is connected across capacitor 30 and primary winding 20*a* with the anode connected to the junction of components 32 and 30 and the cathode connected to AC terminal 16. Hence, when SCR 24 is triggered in conduction, the 300 volts on capacitor 30 is discharged across primary winding 20*a*. As a result, a pulse of 4,000 volts or greater is applied to the trigger electrode of the flash lamp from the secondary of pulse transformer 20. In the specific embodiment, a transformer 20 with a turn ratio of about 1:10 is employed which provides a 10,000 volt pulse. This pulsing ionizes the xenon fill gas, and if the anode to cathode voltage is sufficient to sustain ionization, the lamp will conduct heavily until the AC voltage drops below the lamp deionization voltage. Diode 27 then stops current flow when the high side of the line (terminal 12) goes negative, as previously described with respect to FIG. 2. The voltage multiplier comprising diodes 27 and 31, capacitor 29 and current limiting resistor 35 provides the necessary anode to cathode voltage $V_1$ to facilitate starting of the lamp by the aforementioned trigger pulsing.

For maximum intensity, the lamp should be ionized when the anode to cathode voltage is at or very near the peak of the AC waveform. The current peak depends upon the impedances of the line (terminals 12 and 16) and the lamp acting in series. To control the time of pulse ignition of the lamp with respect to phase of the AC source waveform, an RC timing circuit is provided which comprises an adjustable resistor 36 and a charging capacitor 38 series connected across AC terminals 12 and 16. When timing capacitor 18 charges to a predetermined level, a trigger pulse is applied to the gate, or control terminal, of SCR 24 through a coupling circuit comprising a voltage breakdown diode 40, such as a diac or a semiconductor unilateral switch (SUS), and an isolating diode 42. The value of resistor 36 is adjusted to fire SCR 24 near the positive peak of the AC waveform. In the aforementioned specific embodiment, capacitor 38 is selected to have a value of 0.022 microfarads, and resistor 36 has a value of 200K ohms to fire the lamp at or slightly before the peak. Diode 40 is a 30 volt diac so that when capacitor 38 charges to 30 volts, diode 40 breaks down and discharges into the gate of SCR 24 through diode 42, which isolates the SCR gate from negative charges. The coupling circuit further includes two resistors connected in parallel with capacitor 38 to assure resistive damping of the gate circuit of SCR 24 and to discharge capacitor 38 when it charges negatively with respect to the gate. More specifically, a 1000 ohm resistor 44 is connected between the SCR gate and AC terminals 16, and a 220 ohm resistor 46 is connected between the junction of diodes 40, 42 and terminal 16. This arrangement gives capacitor 38 a starting point on each half cycle charge.

The start of RC timing is controlled by a circuit comprising a control switch 48, such as an SCR or triac, coupled across timing capacitor 38 and a zero crossing detector 50 have a pulse output connected to the gate, or control terminal, of SCR 48. The SCR is also connected across the AC source terminals 12 and 16 in series with the resistor 52, which functions to limit the current through the SCR 48. In the specific embodiment, resistor 52 is a 10K ohm, 2 watt device. The junction of RC components 36, 38 is coupled to the junction of SCR 48 and resistor 52 through diode 54. When SCR 48 is conducting, capacitor 38 cannot charge; hence SCR 48 is turned off to start the charge cycle of AC timing circuit. Diode 54 isolates resistor 52 from resistor 36 during the charge time of capacitor 38.

A number of integrated circuit (IC) units are available for use as zero crossing detector 50. The aforementioned specific embodiment employed an RCA zero-voltage switch type CA3059. In this specific case, leads 7 and 8, (not shown) of the IC unit are tied together and connected to the AC terminal 16. Resistor 56, having a value of 8.2 K ohms, is series connected between lead 5 (not shown) of the IC unit and AC terminal 12 to power the zero crossing detector. Leads 2 and 3 (not shown) of the IC unit are tied together and coupled through a 100 microfarads, 16 volt DC capacitor 58 to AC terminal 16; this capacitor acts as a filter for the 8 volts DC of the IC unit. Lead 4 (not shown) of the IC unit is connected to the gate of SCR 48, and resistors 60, 62 and 64 are connected in series across capacitors 58. With the junction of resistors 60 and 62 being connected to lead 9 (not shown) of the IC unit. In the specific embodiment, resistor 60, 62 and 64 have values of 10K ohms, 4.7K ohms, and 18K ohms respectively. A resistor 65, which has a value of 5.1K ohms, is connected between the gate of SCR 48 and AC terminal 16. A switching function is provided across resistor 64 by the "initiate" switching circuit 18 which is shown connected between AC terminal 16 and the junction of resistors 62 and 64. Leads 10, 11 and 13 (not shown) of the IC unit are tied together to provide a one-to-one differential amplifier so that when resistor 64 shorted out, the ratio of resistors 60 and 62 allows the IC unit to generate a 1.5 volt pulse every time the AC waveform crosses zero. This keeps the SCR 48 conducting, whereupon capacitor 38 is prevented from charging. When the switching circuit across resistor 64 is opened, zero crossing detector 50 is turned off. As a result, SCR 48 is also turned off when the waveform therethrough crosses zero; capacitor 38 then starts charging and the flashlamp triggering cycle occurs. With this circuit, capacitor 38 will begin charge at the same point, zero, regardless of when switching circuit 18 is opened. Accordingly, SCR 24 fires at a constant select time, and the flash intensity remains constant.

Figure 4:
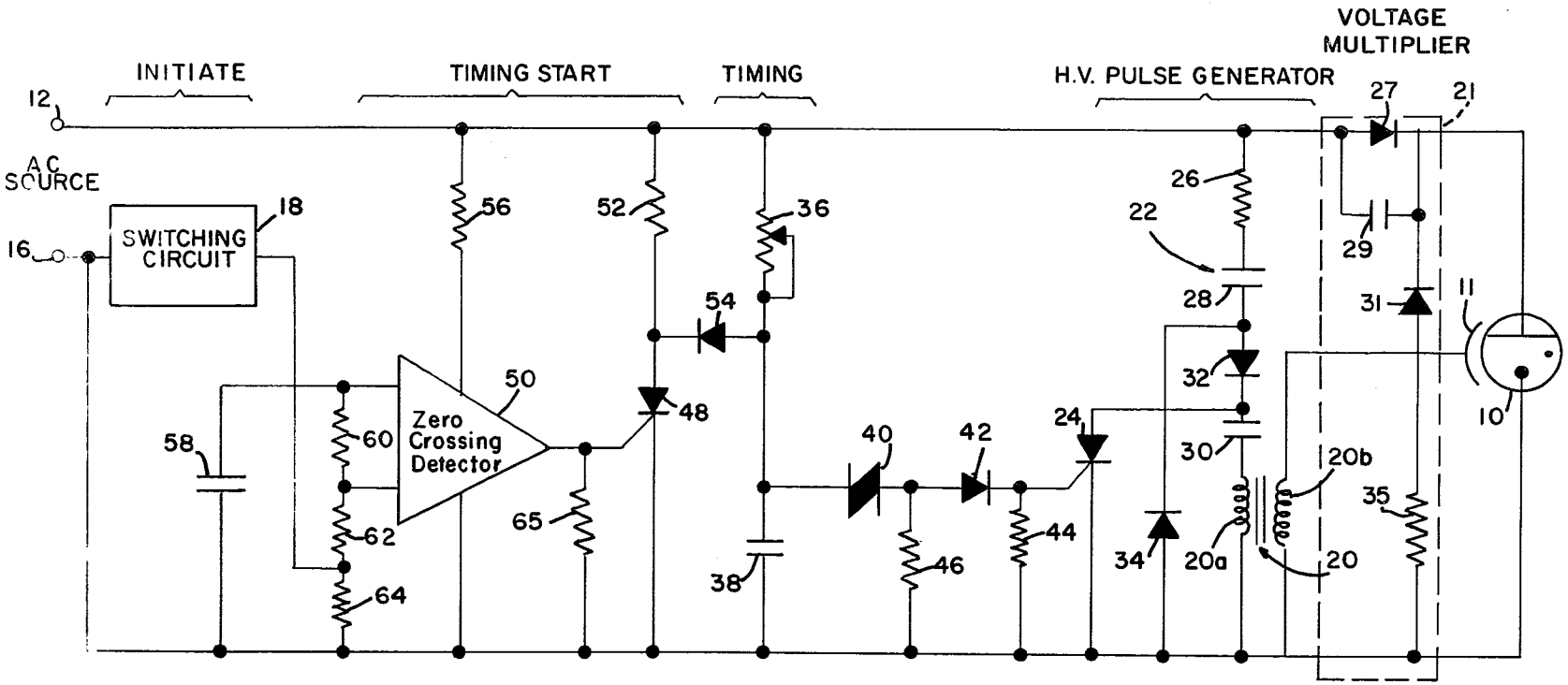
FIG. 4 is a schematic diagram of a preferred circuit for operating a flashlamp directly from an AC source and including a multiplier circuit in accordance with the invention.

In a specific embodiment of the voltage multiplier of FIG. 4, diodes 27 and 31 were type 1N4724; capacitor 29 was 0.1 microfarad, 600 volts; and, current limiting resistor 35 was 330 ohms, 2 watts. The voltage $V_o$ was 340 volts (for a 240 volt RMS service), and the peak voltage $V_1$ provided by the multiplier across the lamp was about 680 volts.

Although the described circuit can be made using component values in ranges suitable for each particular application, as is well known in the art, the following table lists component values and types for one flashlamp operating circuit made in accordance with the present invention.

Diodes 29 and 31—IN4724
Capacitor 29—0.1 microfarad, 600 volts
Capacitor 30—0.15 microfarad, 600 volts
Diodes 32,34,42 and 54—IN4004
Capacitor 28—0.01 microfarad, 200 volts
Resistor 26—2400 ohms, 1 watt
Resistor 35—330 ohms, 2 watts
SCR 24—2N444
Resistor 44—1000 ohms
Resistor 46—220 ohms
Diode 40—ST-2
Resistor 36—200K ohms
Capacitor 38—0.022 microfarad, 400 volts
Resistor 52—10K ohms, 2 watts
SCR 48—2N5064
Resistor 56—8200 ohms, 3 watts
Resistor 60—10K ohms
Resistor 62—4700 ohms
Resistor 64—18K ohms
Capacitor 58—100 microfarads, 16 volts
Resistor 65—5100 ohms
Transformer 20—1:30 turns ratio Although the invention has been described with respect to specific embodiments, it will be appreciated that modifications and changes may be made by those skilled in the art without departing from the true spirit and scope of the invention. For example, the AC terminals 12 and 16 may comprise any pair of legs of a wye or delta connected three-phase service.

What we claim is:

1. A circuit for operating an arc discharge flash lamp directly coupled across a source of alternating current, said circuit comprising:

trigger pulse generating means connected to said alternating current source to be energized thereby and coupled to said flash lamp for applying pulsed high voltage to ignite the lamp; and a voltage multiplier coupled across said flash lamp for increasing the voltage across the lamp above that provided by said alternating current source, thereby facilitating starting of the lamp by said trigger means;

said voltage multiplier comprising a first diode connected in series with said lamp, a capacitor connected across said first diode, and a second diode connected across said lamp, said first and second diodes having cathode terminals electrically connected together, said diodes and capacitor ceasing to function as a multiplier once the lamp is started, whereupon said first diode directly couples said lamp to said AC source and assures that said lamp, when ignited during a half cycle of predetermined polarity of the alternating current waveform of said source, is turned off when said waveform goes to the opposite polarity.

2. The circuit of claim 1 wherein said alternating current source is single phase, and said multiplier provides a voltage across said lamp which is about double the voltage of said source.

3. The circuit of claim 1 wherein said alternating current source is split phase, and said multiplier provides a voltage across said lamp which is about four times the voltage of a single phase of said source.

4. The circuit of claim 1 further including a first resistor in series with said second diode for limiting the current through said second diode.

5. The circuit of claim 4 further including a second resistor connected in parallel with said capacitor and first diode for forming a voltage divider with said first resistor, said voltage divider being operative to affect the voltage provided across said lamp by said multiplier.

6. The circuit of claim 1 further including a resistor connected in parallel with said capacitor and first diode for bleeding off any residual charge on said capacitor when said circuit is deenergized.

7. The circuit of claim 1 further including an external trigger electrode mounted in close proximity to said flash lamp for capacitively coupling pulsed high voltage to the lamp, said trigger pulse generating means being connected to said trigger electrode, whereby said lamp is adapted to be shunt triggered.

8. The circuit of claim 1 wherein the output of said trigger pulse generating means comprises a pulse transformer having a secondary winding connected in series with said flash lamp, whereby said lamp is adapted to be injection triggered.

* * * * *